United States Patent [19]

Wissman et al.

[11] Patent Number: 4,762,239

[45] Date of Patent: Aug. 9, 1988

[54] APPARATUS INCLUDING A PORTABLE HOIST AND GRAPPLES FOR USE IN REPAIRING WATER MAIN METERS

[75] Inventors: Edward E. Wissman, Millersville; Vincent Tenaglia, Hyattsville, both of Md.

[73] Assignee: Washington Suburran Sanitary Commission, Hyattsville, Md.

[21] Appl. No.: 101,606

[22] Filed: Sep. 28, 1987

[51] Int. Cl.[4] ..... B66C 23/18

[52] U.S. Cl. ..... 212/179; 212/218; 212/220; 29/700; 294/82.1

[58] Field of Search ..... 29/213 R, 700; 212/205, 212/218, 220, 271, 175, 179; 294/81.1, 67.1, 82.1

[56] References Cited

U.S. PATENT DOCUMENTS

| | | | |
|---|---|---|---|
| 1,546,700 | 7/1925 | Allen et al. | 212/220 |
| 1,952,238 | 3/1934 | Dice | 212/218 |
| 2,368,390 | 1/1945 | Winter | 212/218 |
| 2,436,337 | 2/1948 | Smith et al. | 212/218 |
| 2,708,525 | 5/1955 | Woleslagle | 212/179 |
| 2,833,423 | 5/1958 | Tucker | 212/179 |
| 3,064,824 | 11/1962 | Beatty | 212/179 |
| 3,945,105 | 3/1976 | Beaty et al. | 29/700 |
| 4,648,647 | 3/1987 | Patton | 212/218 |

*Primary Examiner*—Joseph F. Peters, Jr.
*Assistant Examiner*—Stephen P. Avila
*Attorney, Agent, or Firm*—Millen & White

[57] ABSTRACT

Apparatus is provided for assisting in the repair of valves used in water line meters. The apparatus comprises a travel lift mounted on a collapsible frame specifically configured for erection on water line meters. Grapples are included for grappling a valve chamber cover, a pivoted weight and a valve so that elements of the valve can be removed from the meter for repair.

8 Claims, 7 Drawing Sheets

APPARATUS INCLUDING A PORTABLE HOIST AND GRAPPLES FOR USE IN REPAIRING WATER MAIN METERS

BACKGROUND OF THE INVENTION

The instant invention relates to apparatus used to facilitate the repair of valves utilized in underground water main meters.

In order to account for and bill for water dispensed by large water systems, such as municipal water systems, meters of various sizes are distributed throughout the system. One type of meter utilized is the Hersey Fire Line meter which comprises a meter inserted into the main wherein the meter includes a relatively large, weighted swing-arm valve which opens when pressure loss through the bypass meter approaches 4 psi. Connected in parallel with the relatively large valve is a domestic bypass meter having a relatively small swing-arm valve which responds to domestic consumption on the order of one gallon per minute or less. Disposed downstream of each valve is a register read by visual inspection.

It has been found that enormous quantities of water are dispensed without being billed for or accounted for due to deterioration of components of the swing-arm valves. This is usually due to the rubber seal adjacent the periphery of the valve being damaged by periodically closing on pebbles and other debris passing through the water main. These valves include a weight copivoted with the valve and a roller which rides on the weight. From time to time, the roller degrades or jams. This can also cause the valve to remain open, allowing quantities of water dispensed without being billed for.

Normally, Hersey Fire Line meters are contained in underground meter vaults which are entered through a standard twenty-two inch manhole cover and have a floor-to-ceiling height of approximately six feet. The mains to which the fire meters are attached are generally eight to twelve inches in diameter. Consequently, the valves are quite heavy as are the valve covers. For example, the weight of the valve cover on a Hersey ten-inch fire meter is approximately two hundred seventy-three pounds, the weight of the valve is approximately one hundred fifty-six pounds, while the weight itself is approximately ninety-six pounds. Handling equipment of this weight is difficult and hazardous for work crews, requiring two or three workmen to lift very heavy items in a confined space. Since these valves are difficult to maintain, water departments frequently let the valves leak which nationwide results in hundreds of millions of gallons of water being dispensed unmetered. This, of course, increases the price of water to users where the water is metered.

In view of these considerations, there is a need for apparatus specifically for handling valves and valve covers used in large water-metering equipment, such as the eight and twelve-inch Hersey Fire Line meters.

SUMMARY OF THE INVENTION

It is an object of the instant invention to provide a new and improved hoist specifically for use in servicing fire meters installed in water mains wherein the hoist can be readily assembled and disassembled for transport and erection in meter vaults.

In view of the foregoing object and other objects, the instant invention contemplates a hoist comprising a pair of vertical struts for supporting a horizontal beam in spaced relation to a fire meter. The struts each have semi-circular base members for mounting the struts on the meter and couplings for detachably retaining the beam thereto. A pair of stabilizing struts extend downwardly and laterally from the beam and are attached to the domestic bypass portion of the fire meter in order to rigidify the frame. The hoist is mounted on the beam for traverse between the two supporting struts so as to move the valve cover longitudinally with respect to the meter wherein access may be gained into the meter to allow removal of the valve for maintenance purposes.

Preferably, the hoist has a self-activating brake which holds the load securely in place whenever the hand crank is released. It has been found that a nylon rope is preferable to a steel cable since maintenance personnel tend to manually grip the cable when maneuvering the load.

The invention also includes specifically configured grapples for attachment to the valve assembly and weight in order to lift the valve assemblies and weight from the meter housing.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
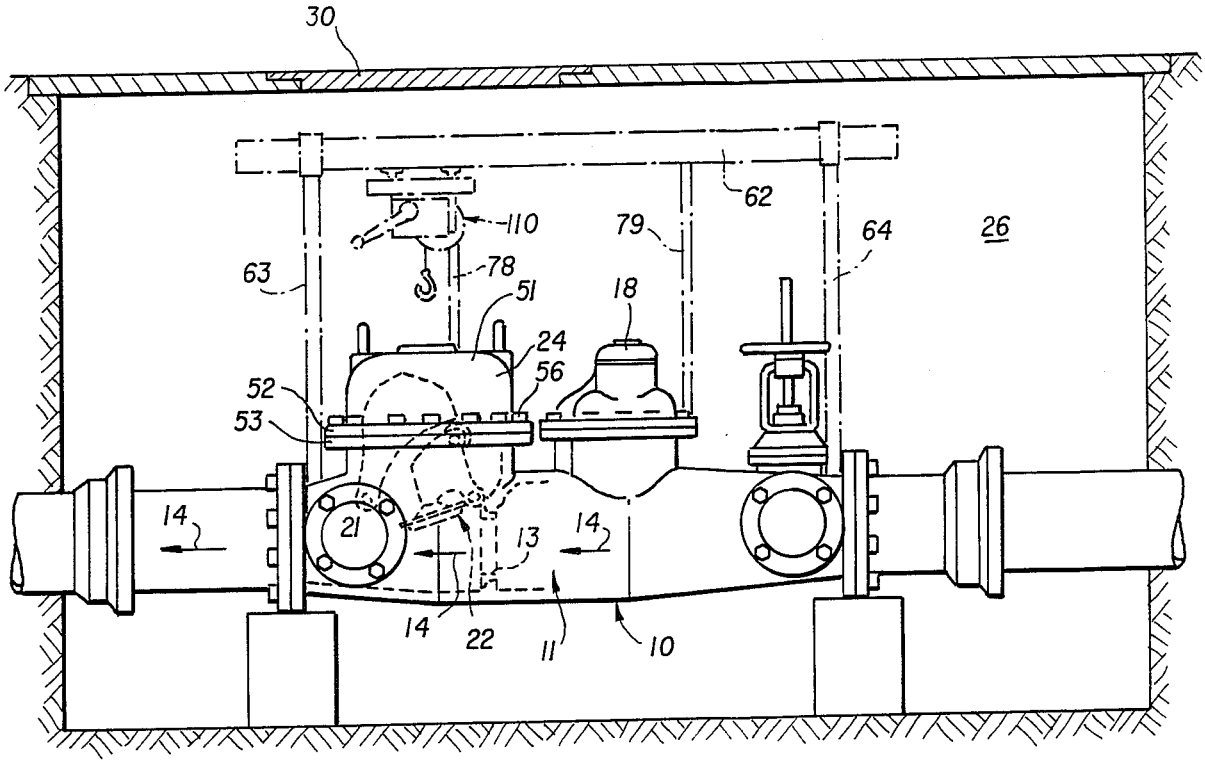
FIG. 1 is a side view of a fire line meter installed in a vault with a hoist according to the instant invention mounted thereon.
Figure 2:
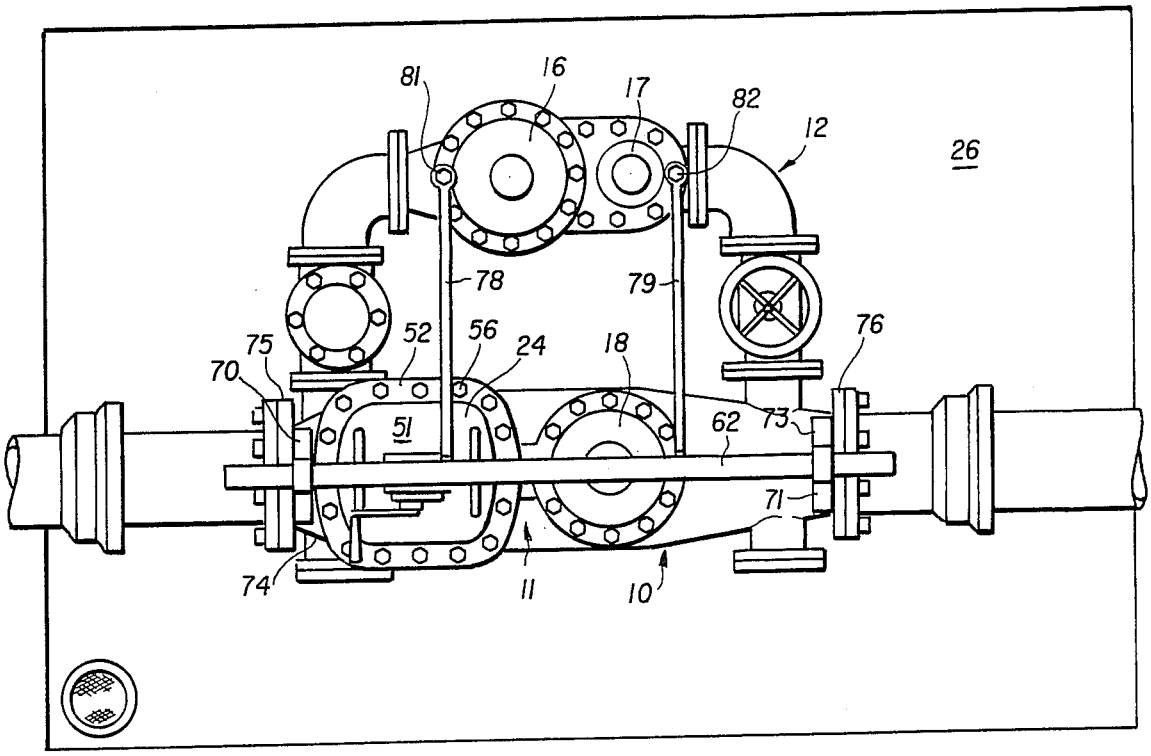
FIG. 2 is a top view of the meter and hoist shown in FIG. 1.
Figure 3:
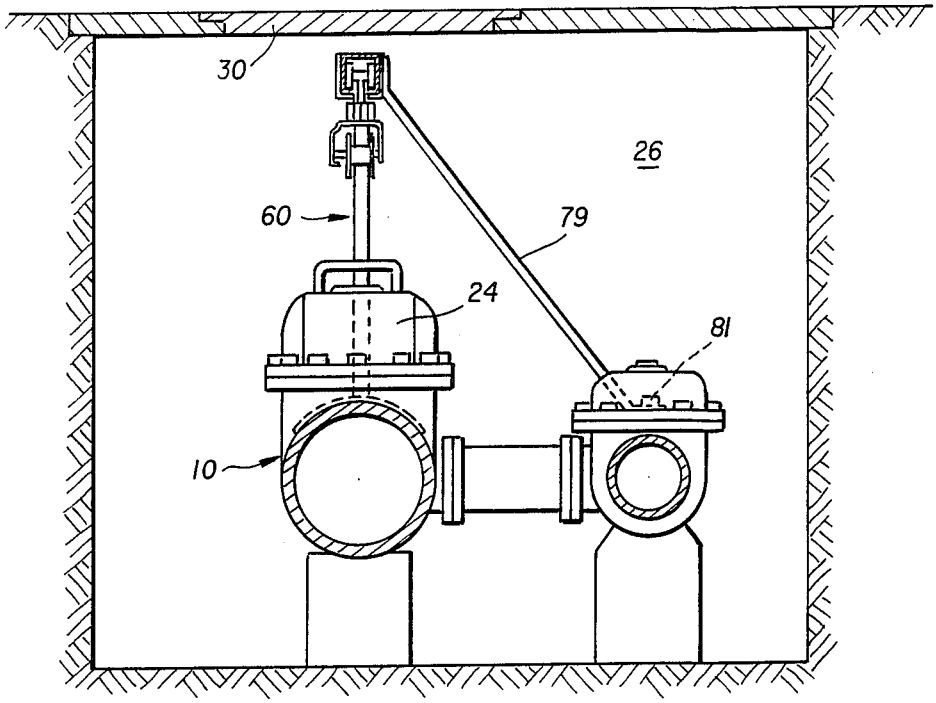
FIG. 3 is an end view of the meter and hoist of FIG. 1.

Referring now mainly to FIGS. 1–3 and 7–9, there is shown a water meter, designated generally by the numeral 10, which, for the purposes of disclosure, might be a Hersey Model No. MFM-CT, manufactured by Hersey Products, Inc., of Dedham, Mass. The meter 10 includes a main line measuring chamber, designated generally by the numeral 11, and a domestic bypass, measuring chamber, designated generally by the numeral 12. The main line measuring chamber 11 includes a valve assembly, designated generally by the numeral 13, which, when in the FIG. 9 position, remains closed blocking flow of water through the main line measuring chamber in the direction of arrows 14. As long as the valve assembly 13 is closed, water in the main will flow through the bypass 12 and be metered by meters 16 and 17 (FIG. 1) therein, which meter water for ordinary domestic consumption at relatively low rates. However, if there is a demand for flow rates in excess of a relatively large flow rate, then the valve 13 opens to the dotted line position and water flows through the main line valve 13. When this happens, a main line meter 18, which is calibrated to read relatively large flow rates, commences operation. Large capacity meters, such as the meter 18, cannot measure flow rates below their threshold level, for example, if the valve 13 is in disrepair or defective for some reason it will allow quantities of water to dispense through meters 12 and 13 without being billed for. The valves 13 open and close rather abruptly when the downstream demand exceeds the threshold level. Frequently, when water is flowing at high rates through the valve 13, debris entrained in the water damages the valve by sitting, tearing or perhaps even lodging in the annular valve seal 21 (see FIGS. 7 and 9) which seats against a aluminum valve seat 22 in order to shut off flow when the valve is closed. In a municipal water distribution system, there may be hundreds or even thousands of meters such as the meter 10 which can, if not properly maintained, leak tens of millions of gallons of water per year. While the meters 10 are configured for maintenance without removing them from the line, in situ maintenance can be very difficult due to the weight of the components of the valve 13 and the weight of an access cover 24. The problem is compounded due to the cramped working area provided by the underground vault 26 which houses the meter 10. Typically, a vault 26 for a meter 10 used with a ten-inch main will be fifteen and one-half feet long, nine feet wide and six and one-half feet high. The meter assembly 10 itself is approximately five feet wide, nine feet long, and has a ceiling from the top of the meter to the ceiling of forty-one inches. Generally, the manhole cover 30 for gaining access to the meter vault 26 has a diameter in the range of twenty-two to forty-two inches. Consequently, the meter vault 26 is a cramped compartment with limited access.

Combined with limited access and cramped working conditions are the difficulties workmen encounter in removing the valve assembly 13 for maintenance. In eight and ten-inch mains, the valve assemblies 13 have two relatively heavy elements. Each valve assembly 13 includes a swing-arm 40 which mounts a clapper disc 41 to which the annular seal 21 is attached. The swing-arm 40 is pivoted in a spindle 43 which spindle passes through the housing 42 of the meter 10. The swing-arm 40 and clapper disc 41 weigh approximately one hundred fifty-six pounds. Cooperating with the swing-arm 40 is a pivoted weight 44 which is mounted on a spindle 46 also received in the housing 11 of the main line measuring chamber 11. In a meter 10 used with a ten-inch main, the pivoted weight 44 weighs approximately ninety-six pounds and bears against a roller 47 on the swing-arm 40 which roller tends to degrade over time and interfere with proper operation of the valve 13. When the swing-arm 40 and pivoted weight 44 are in the open position (FIGS. 1 and 7), they swing through an opening 51 in the top of the housing defining the main line measuring chamber 11. The cover 24 has a peripheral flange 52 which mates with a flange 53 on the main line measuring chamber 11 and is secured thereto by a plurality of bolts 56. In order to gain access to the valve assembly 13, the cover 24 must, of course, be removed. However, the cover 24 used with a 10-inch water main weighs two hundred eleven pounds. In a cramped environment such as that of the meter vault 26, removal and replacement of the cover requires at least three maintenance workers. Even after the cover is removed, the maintenance workers must somehow reach into the interior of the main line measuring chamber 11 and extract the ninety-three pound weight 44 and one hundred fifty-six pound valve arm 40. Both the weight 44 and the valve arm 40 must also be supported while the spindles 43 and 46 on which these members are pivoted are removed. According to general practice, the manhole opening 30 into the meter vault 26 is in the corner of the meter vault. Consequently, the manhole opening 30 is not aligned with the cover 24 so one cannot utilize currently available equipment to perform the aforementioned removal and replacement functions. Accordingly, in the United States alone, thousands of main line meters, such as the meter 10, are simply left to malfunction, dispensing hundreds of millions of gallons of water upon which no revenue is collected. The economic consequences of this are felt by everyone who relies on public water systems for their water.

In order to facilitate maintenance and repair of valve assemblies such as the valve assembly 13, the instant inventors constructed a travel lift assembly, designated generally by the numeral 60, with a plurality of interchangeable grapples in order to conveniently remove the cover 24; extract the swing-arm clapper assembly 40, 41 and 42 and the pivoted weight 44, and thereafter to replace these elements with a refurbished valve assembly 13 and then reposition the cover 24. With the hoist 60, this task is accomplished quickly and safely with two maintenance workers.

Considering the travel lift 60 more specifically, it is seen that the travel lift comprises a beam 62 which is supported by a pair of vertical struts 63 and 64 having U-shaped brackets 65 and 66, respectively, which received the beam 62 therein. The beam 62 has a plurality of lateral bores 67 therethrough which receive bolts or pins 68 that also pass through coaxial bores in the U-shaped brackets 65 and 66. The struts 63 and 64 each have semi-circular bases 70 and 71, respectively, which rest on the main line measuring chamber 11 on circular surfaces 73 and 74 (FIG. 7) adjacent the inlet and outlet ends of the main line measuring chamber, respectively. The chamber 11 has a flange 75 adjacent its inlet and a flange 76 adjacent its outlet end, inboard of which the bases 70 and 71 seat. A pair of obliquely extending lateral struts 78 and 79 are bolted to the beam 62 at one end and are bolted to flange bolts 81 and 82, respectively, on the domestic bypass meter 12. The semi-circular bases 70 and 71 and the lateral struts 78 and 79 provide a stable secure frame for supporting the travel lift assembly 60.

Figure 5:
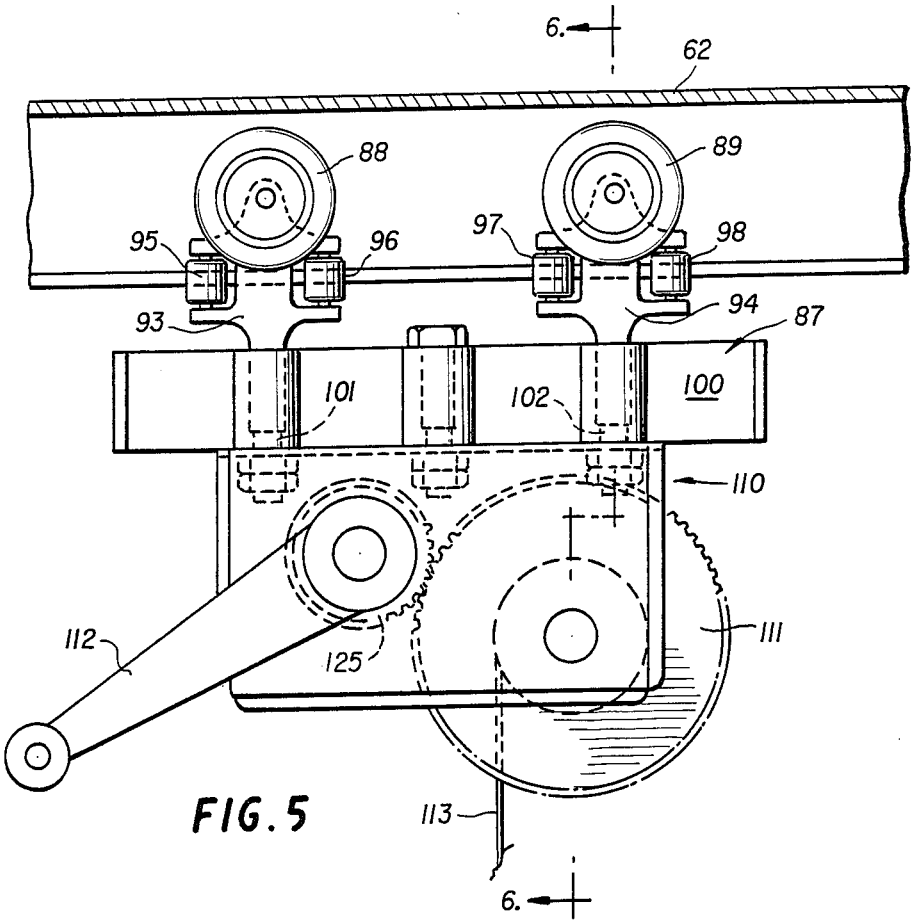
FIG. 5 is a side view with portions shown in dotted lines of a trolley and winch used with the hoist shown in FIGS. 1–4.
Figure 6:
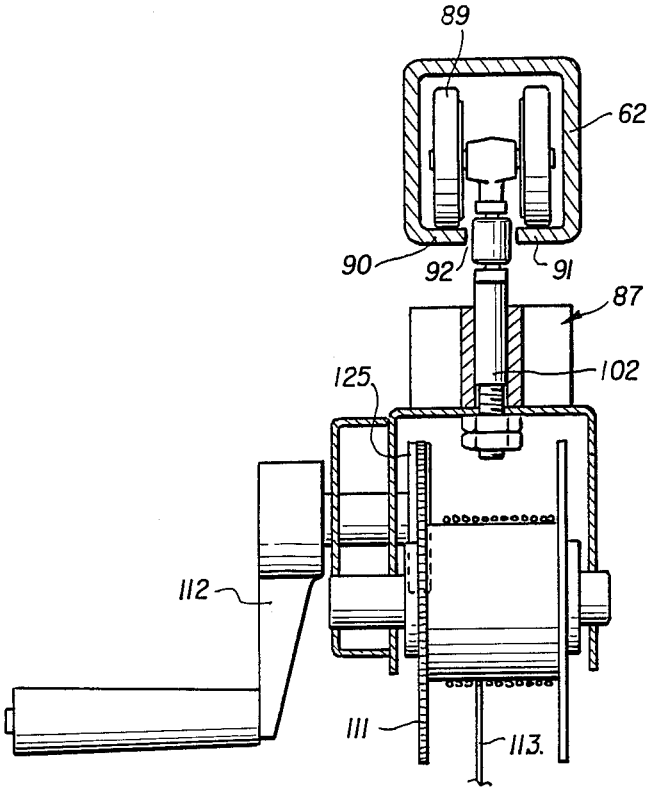
FIG. 6 is an end view of the trolley and winch shown in FIG. 5.

As is best seen in FIGS. 5 and 6, a trolley, designated generally by the numeral 87, and having first and second pairs of wheels 88 and 89 which are received within the beam 62, rolls on a pair of opposed flanges 90 and 91 adjacent a slot 92. Projecting through the slot 92 are supports 93 and 94 in which the wheels are journalled and which have leading and trailing rollers 95, 96, 97 and 98 which engage the edges of the flanges 90 and 91. A bracket 100 receives shanks of bolts 101 and 102 extending from the wheel supports 93 and 94, respectively, to form the trolley assembly which traverses the beam 62 longitudinally when pushed manually.

Figure 4:
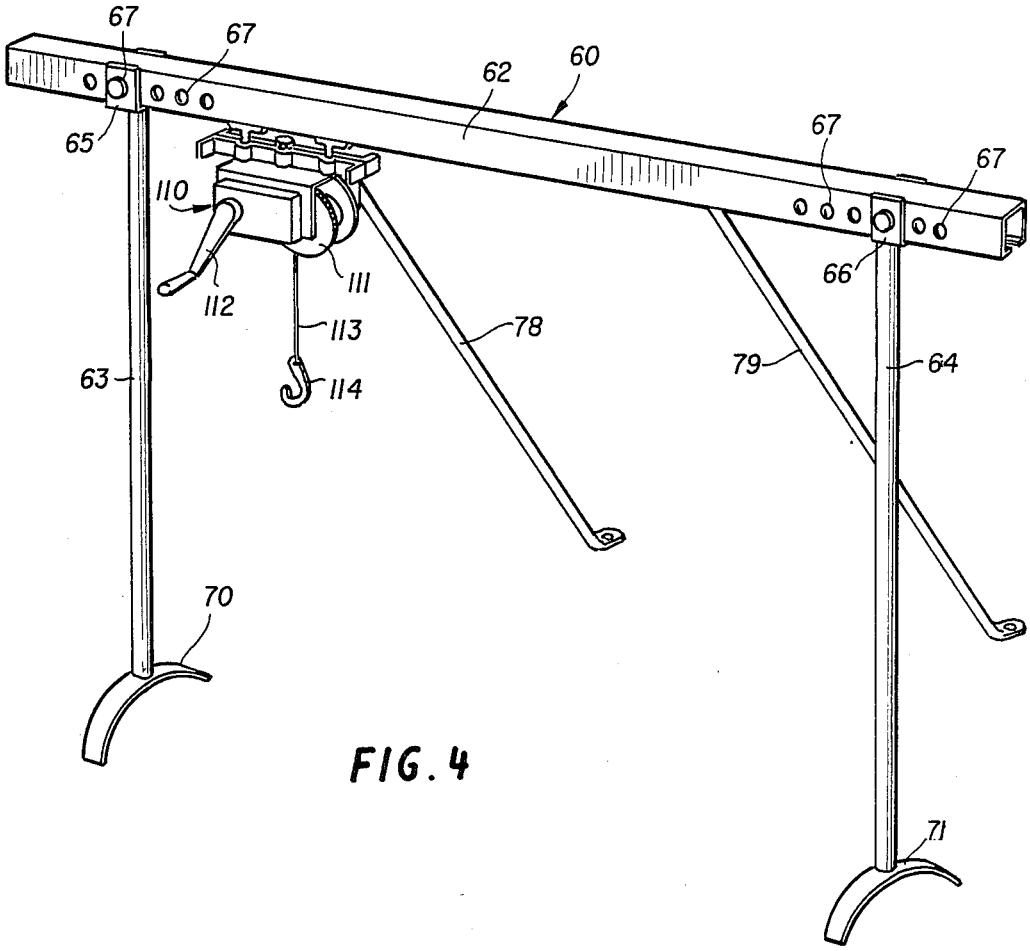
FIG. 4 is a perspective view of the hoist according to the instant invention.

Attached to the bolts 101 and 102 and held securely on the support bracket 100 by nuts 105 and 106 is a conventional brakewinch, designated generally by the numeral 110. A preferable brakewinch is one manufactured by the Dutton-Lainson Company Stock No. 4Z082. The brakewinch 110 has the drum 111 which is turned by a hand crank 112. Wound around the drum 111 is a NYLON line 113 having a braking strength of approximately 1,600 pounds. The NYLON line 113 has a hook 114 (FIG. 4) attached to the end for selectively engaging one of the three grappling devices 120, 121 and 122 shown in FIGS. 8, 11 and 13, respectively. Brake winch 110 is a self-activating brake winch which utilizes a brake-and-clutch mechanism 125 hold the load securely whenever the hand crank 112 is released during the loading or unloading. The drum 111 will not free wheel and requires an operating load of seventy-five pounds. By using a NYLON line rather than a stranded steel cable, injuries to workers' hands which result from broken cable strands are avoided.

Figure 7:
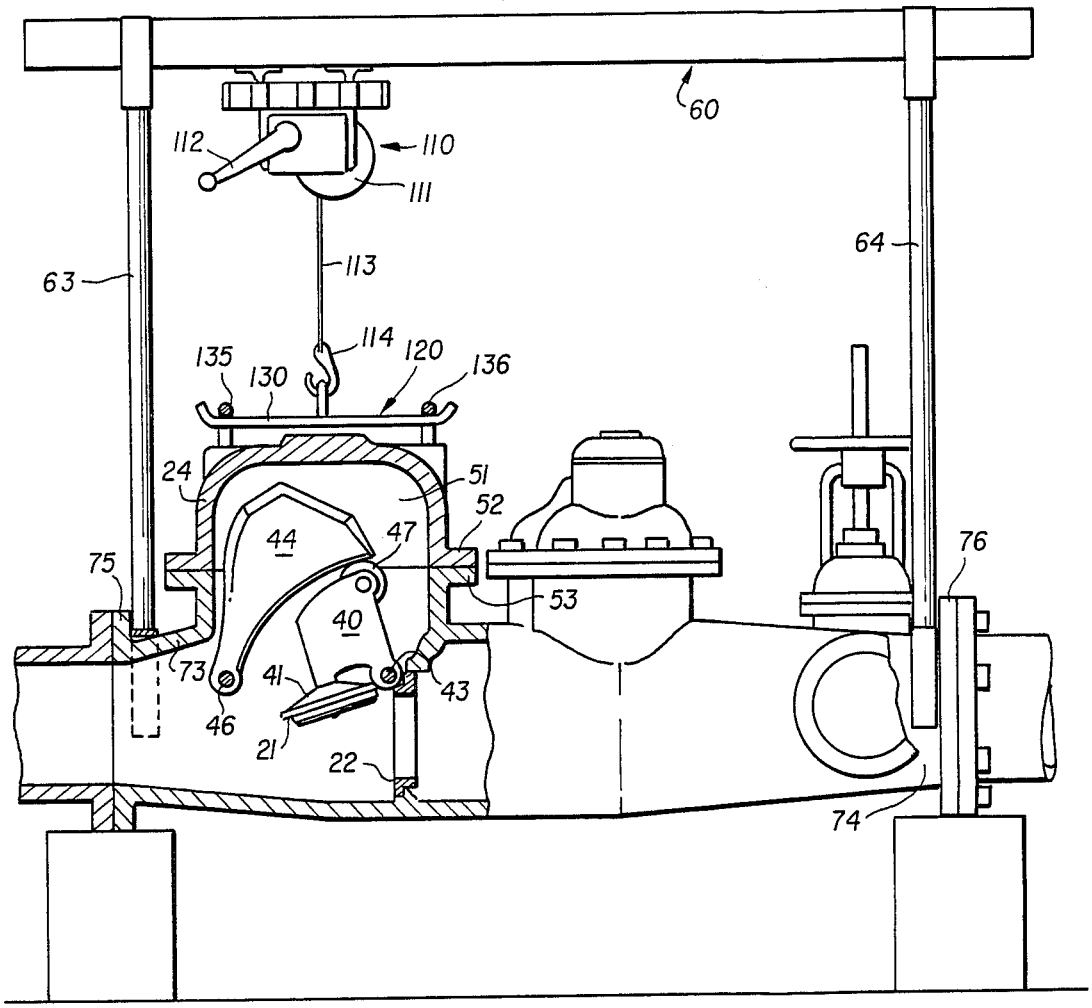
FIG. 7 is a side view of the hoist and meter showing the hoist positioned to lift the valve cover.
Figure 8:
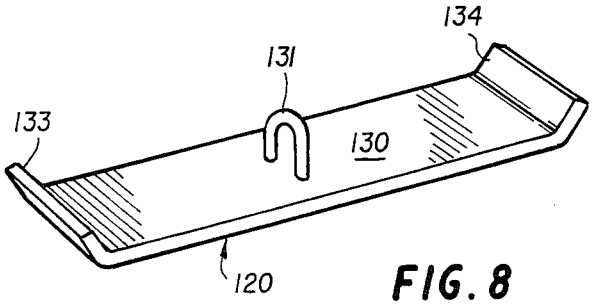
FIG. 8 is a perspective view of a grapple used to lift the valve cover.
Figure 9:
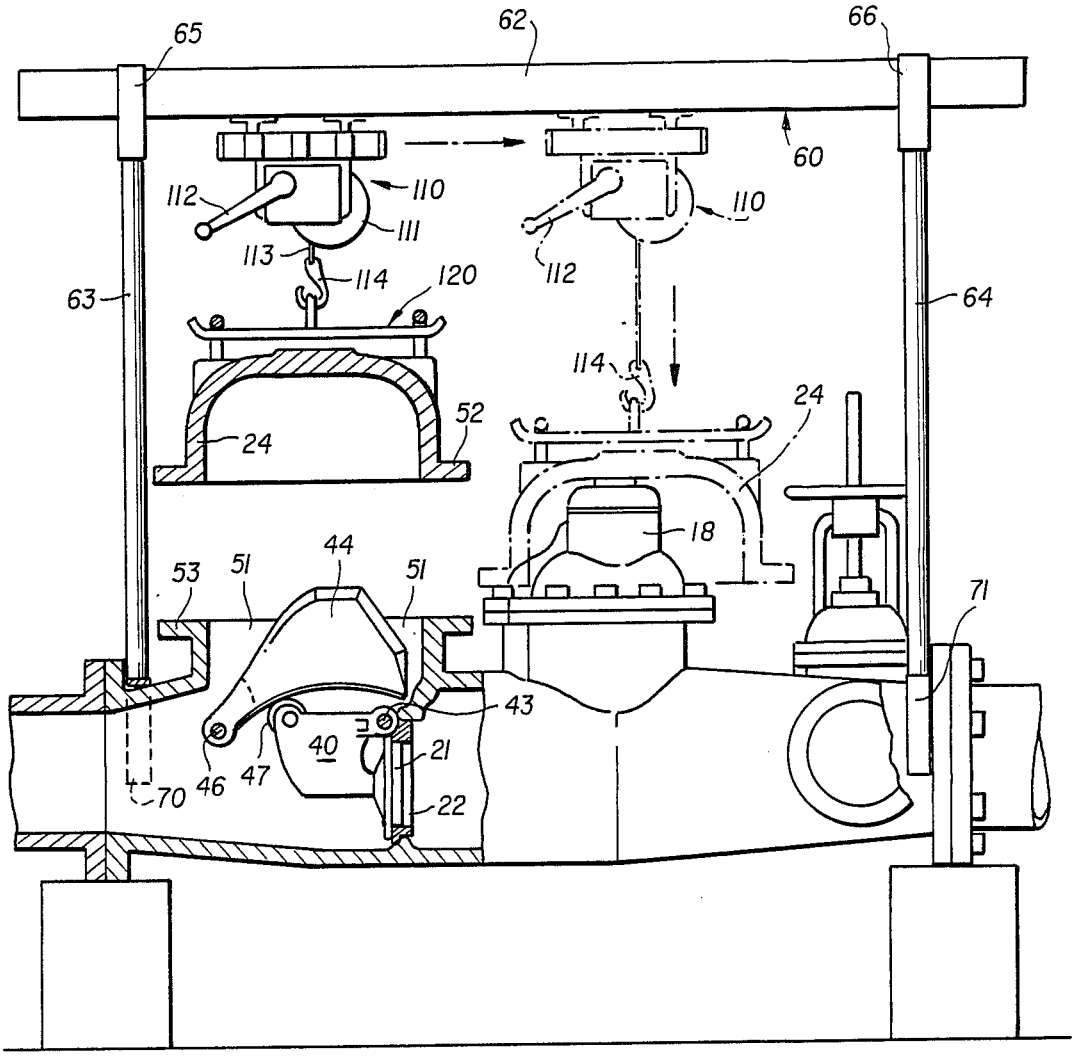
FIG. 9 is a side view showing the grapple cover being lifted and in dotted lines being set aside.

Referring now to FIGS. 7, 8 and 9 there is shown the first grappling device 120 which is simply a flat, rectangular plate 130 having a central eye 131 in which the hook 114 attached to the line 113 engages. At the ends of the flat rectangular plate 130 are a pair of flanges 133 and 134 which extend normal thereto. The flanges 133 and 134 fit outboard of a pair of inverted U-shaped handles 135 and 136 on the cover 24 of the main line meter chamber 11. In order to remove the cover 24 from over the opening 51 in the meter chamber 11, the grapple 120 was simply positioned over the cover 124 and beneath the handles. Upon cranking up the winch 110, the cover 24 is vertically displaced so that it can be laterally moved away from the opening 51. Generally, the cover 24 is simply moved laterally until it can be placed over the meter 18 and is then lowered and rested on the meter house 11. The hook 114 is then disengaged from the eye 131 and the trolley 87 is returned to a position over the opening 51 so that the pivoted weight 44 and swing-arm 40 can be removed.

Figure 10:
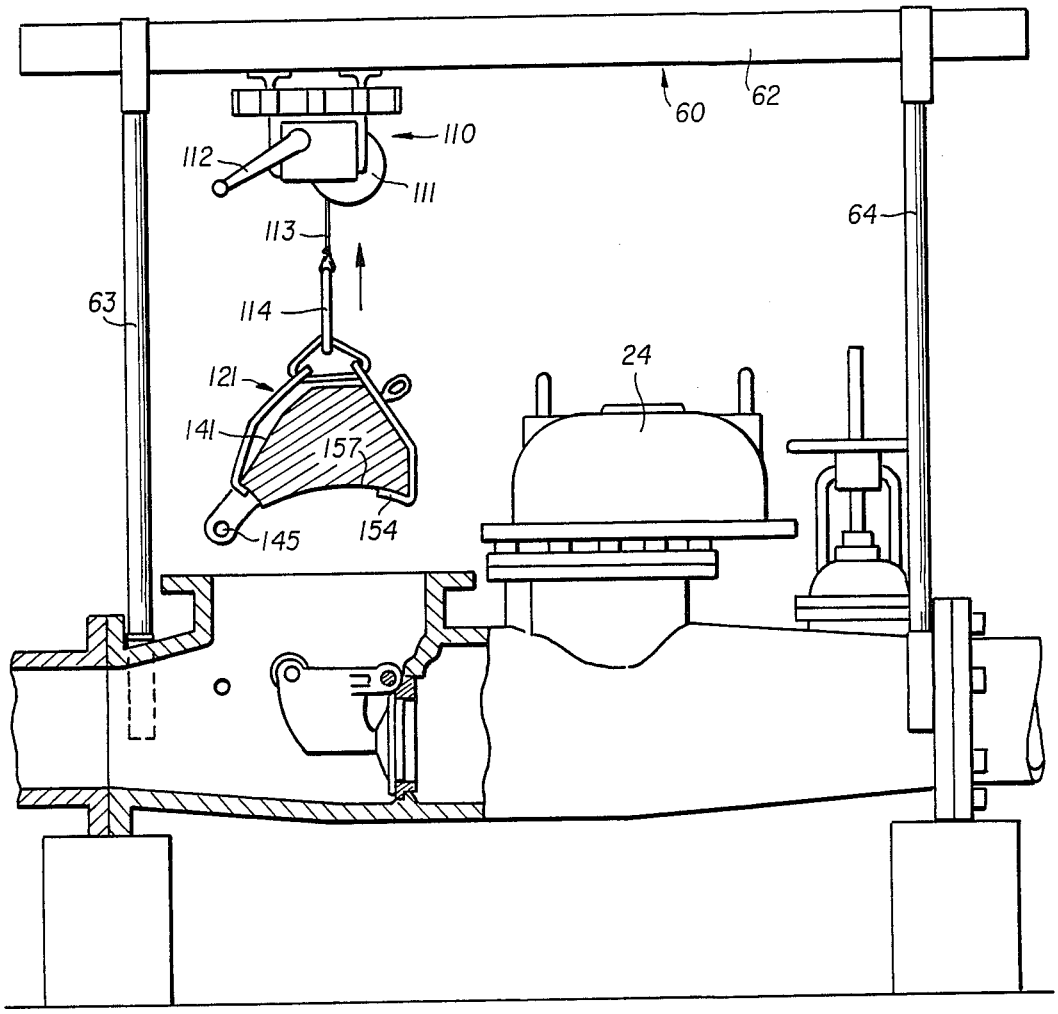
FIG. 10 is a side view showing the weight being lifted from the housing.
Figure 11:
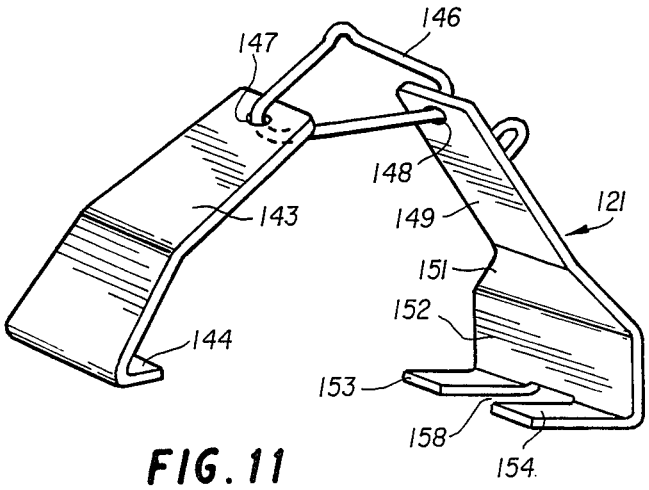
FIG. 11 is a perspective view of a grapple for lifting the weight.

Referring now to FIGS. 10 and 11, the pivoted weight 44 is removed by securing the grapple 121 around the upper surface 141 of the weight 44. The grapple 121 has a first plate 143 with a hook 144 at the end thereof, which hook fits just inboard of the hole 145 for spindle 46 which supports the pivoted weight 44. A link 146 passes through a bore 147 in the plate 143 and through a bore 148 in a second plate member 149. The second plate member 149 has a flared portion 151, and angled portion 152 and a pair of spaced flanges 153 and 154 to conform the shape of the second plate to the free end portion of the underside 157 of the pivoted weight 44. The flanges 153 and 154 define a space 158 therebetween which receives the circular roller 47 journalled on the swing-arm 40 of the valve 13. In order to remove the pivoted weight 44, the grapple 121 is secured to the weight by engaging hook 114 with the link 146 and the line 113 tensioned enough to support the pivoted weight. The spindle 46 is then extracted and the pivoted weight 44 lifted through the opening 51 in the main line measuring chamber 11. The pivoting weight 44 can then be inspected and, if maintenance is necessary, transferred to another hoist (not shown) on a truck above ground and lifted through the manhole cover so that it can be taken back to the shop and refurbished.

Figure 12:
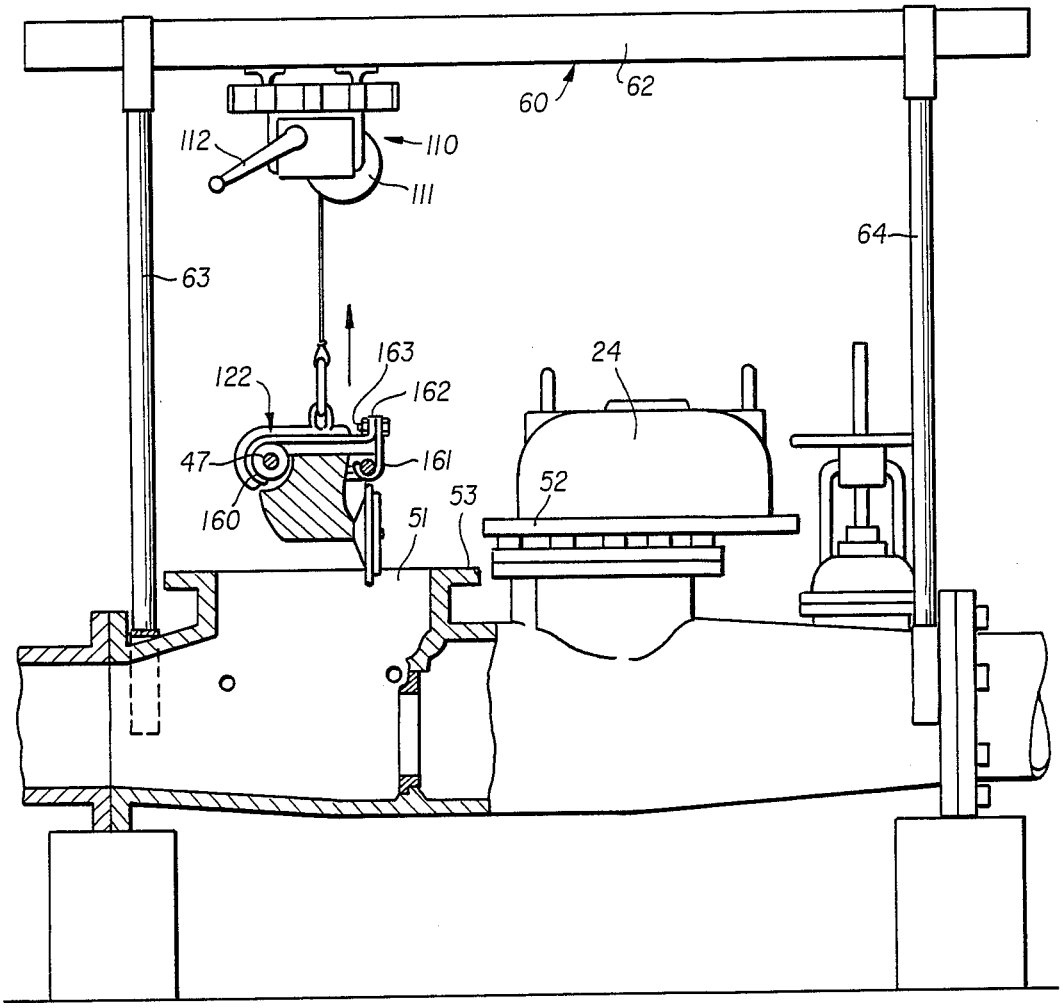
FIG. 12 is a side view showing the valve assembly being lifted from the housing.
Figure 13:
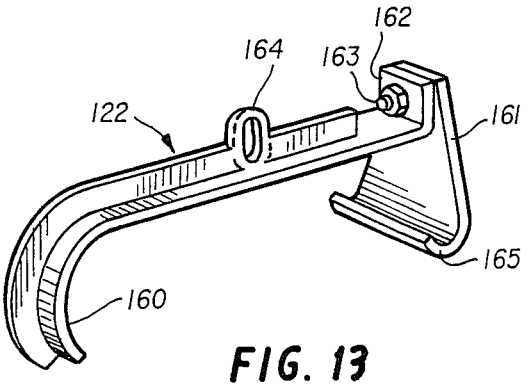
FIG. 13 is a perspective view of the grapple for lifting the valve assembly.

Referring now to FIGS. 12 and 13, the swing-arm 40 and valve assembly 41, 21 is then removed by engaging it with the grapple 122. Since the pivoting weight 44 has been removed, the swing-arm 40 is readily accessible through the opening 51. The grapple 122 has a first hook 160 at one end which fits over the circular roller 47 and a second hook 161 which is attached to a flange 162 by a bolt 163. The hook 161 has a U-shaped end 165 which fits around the spindle 43 that supports the swing-arm 40. The spindle 43 is disengaged from the housing of the main line measuring chamber 11 by unscrewing hinge spindle plugs 168 positioned on both sides of the housing after slightly tensioning the NYLON line 113 which is attached to an eye 164 on the grapple 122. The valve arm 40 and attached clapper assembly 41-21 can then be removed through the opening 51 by cranking up the NYLON line 113 on the drum 111 and thereafter traversing into a position closer to the manhole cover where a line from separate hoist (not shown) on the service truck (not shown) above ground is attached to the eye 164 so that the swing-arm valve assembly can be returned to the shop for refurbishing.

A new or refurbished assembly, with a new roller 47 and a new annular valve seal 21 is then lowered through the opening 51 into the main line meter casing 11 using the grapple 122. The spindle 43 is then secured in place with hinge spindle plugs so that the swing-arm 40 is pivoted within the chamber 11. A refurbished pivotal weight 44 is then lowered through opening 51 into the chamber 11 and secured in place by fixing the spindle 46 in the housing with hinge spindle plugs. The housing 24 is then lifted by the grapple 120 of FIG. 5 from its resting position over the meter 18 and returned to its position over the opening 51 by traversing the trolley 100. The cover 24 is then lowered in place and secured by nuts and bolts 56 after being appropriately gasketed.

The travel lift 60 is then disassembled by removing the lateral struts from the bypass meter 12 and the pins from the U-shaped brackets so that the travel hoist can be conveniently passed through the manhole cover.

In this way, the main line meters 10 can be rapidly and conveniently serviced so as to avoid leaks which cost water distributing departments and commissions enormous lost revenues.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. Apparatus for use in repairing valves in water main meters wherein the water main meters include a valve chamber with a cover, a pivoted weight and a valve clapper; the apparatus comprising:

a portable hoist for use in repairing water main meters, the hoist including:

a beam for extending horizontally across the water main meter;

first and second struts each strut having an upper and lower end, the upper end of each strut having means for detachably connecting the strut to the beam the lower end of each strut having an arcuate base with a surface conforming to the shape of the water main meter;

a pair of obliquely extending lateral struts, wherein each lateral strut has a first and a second end, the first end being secured to the beam and the second end to a lateral portion of the meter;

a trolley supported by the beam for horizontal movement thereon from a first position to a second position;

a winch mounted on the trolley, the winch having a winding drum and a cable with coupling means at the free end of the cable;

a plurality of grapples selectively attachable to the coupling means or the cable, the grapples including:

first grappling means securable to the coupling means for lifting the cover from the valve chamber;

second grappling means securable to the coupling means for lifting the pivoted weight from the valve chamber; and third grappling means securable to the coupling means for lifting the valve from the meter.

2. The apparatus of claim 1, wherein the winch includes a manual operating means and a brake-and-clutch means disposed between the manual operating means and the drum which brake-and-clutch means prevents rotation of the winch drum except when operating the manual operating means.

3. The apparatus of claim 2, wherein the cable is in the form of a nylon rope so that the cable may be safely grasped by a maintenance worker.

4. The apparatus of claim 1, wherein the cover has a pair of spaced, inverted U-shaped handles and wherein the first grapple is a plate having first and second ends with upwardly extending flanges thereon spaced apart a distance slightly greater than the distance between the handles, the plate having a centrally positioned eye whereby the plate is positioned beneath the handles while the eye is coupled to the cable for wrenching the cover upwardly and traversing the cover laterally so as to gain access to the valve chamber.

5. The apparatus of claim 4, wherein the pivoted weight includes an upper surface and a lower surface with a slot passing between the upper surface and the lower surface adjacent a mounting pin for the weight, and wherein the grapple includes a first plate with a hooked end and a second plate with a hooked end, the plates being joined by a link and generally conforming to the upper surface of the weight with the hook on the first plate engaging in the slot in the weight and the hook on the second plate engaging the bottom surface of the weight with the link being connected to the coupling means for lifting the weight from the valve chamber upon winding the cable on the winch.

6. The apparatus of claim 5, wherein the second grapple further includes an eye projecting from the second plate and a slot in the hook of the second plate for accommodating a roller on the valve.

7. The apparatus of claim 6, wherein the valve includes a pivoted, weighted portion having a roller at one end and a removable pivot pin at the other end wherein the roller engages the lower surface of the pivoted weight; the third grapple including a first hooked element having a horizontally extending portion with a hook at one end for fitting around the roller and connecting means at the other end with an eye disposed between the ends, the third grapple further including a second hook member with a vertically extending portion and a hook at one end for fitting under the pivot pin of the valve clapper, the second hooked member being joined to the second end of the first member.

8. The apparatus of claim 7, wherein the first hook member is joined to the second hooked member by a bolt and nut.

* * * * *

UNITED STATES PATENT AND TRADEMARK OFFICE

CERTIFICATE OF CORRECTION

PATENT NO. : 4,762,239

DATED : August 9, 1988

INVENTOR(S) : Edward E. Wissman et al

It is certified that error appears in the above-identified patent and that said Letters Patent is hereby corrected as shown below:

Title Page, 73 , Assignee:

should read: --Washington Suburban Sanitary Commission, Hyattsville, Md--

Signed and Sealed this

Twenty-eighth Day of March, 1989

*Attest:*

DONALD J. QUIGG

*Attesting Officer*

*Commissioner of Patents and Trademarks*